US010495080B2

(12) United States Patent
Brancher et al.

(10) Patent No.: US 10,495,080 B2
(45) Date of Patent: Dec. 3, 2019

(54) SUCTION ACOUSTIC FILTER AND SUCTION LINE INCLUDING SUCTION ACOUSTIC FILTER

(71) Applicant: Whirlpool S.A., Sao Paulo (BR)

(72) Inventors: Ricardo Dagnoluzzo Brancher, Joinville (BR); Dietmar Erich Bernhard Lilie, Joinville (BR); Andre Ricardo Popinhak, Joinville (BR); Fabian Fagotti, Curitiba (BR)

(73) Assignee: Embraco-Industria De Compressores E Solucoes EM Refrigeracao, LTDA., Joinville (BR)

( * ) Notice: Subject to any disclaimer, the term of this patent is extended or adjusted under 35 U.S.C. 154(b) by 228 days.

(21) Appl. No.: 15/531,058

(22) PCT Filed: Nov. 26, 2015

(86) PCT No.: PCT/BR2015/050228
§ 371 (c)(1),
(2) Date: May 26, 2017

(87) PCT Pub. No.: WO2016/082016
PCT Pub. Date: Jun. 2, 2016

(65) Prior Publication Data

US 2017/0356432 A1 Dec. 14, 2017

(30) Foreign Application Priority Data

Nov. 27, 2014 (BR) ..... 1020140296590

(51) Int. Cl.
*F04C 29/06* (2006.01)
*F04B 39/00* (2006.01)
(Continued)

(52) U.S. Cl.
CPC ..... *F04B 39/0055* (2013.01); *F04B 39/12* (2013.01); *F04B 53/001* (2013.01); *F04B 53/14* (2013.01); *F04B 53/16* (2013.01)

(58) Field of Classification Search
CPC .... F04B 39/00; F04B 39/125; F04B 39/0061; F04B 39/0038; F04B 39/0055;
(Continued)

(56) References Cited

U.S. PATENT DOCUMENTS 2,229,119 A 1/1941 Nichols et al.
4,370,104 A * 1/1983 Nelson ..... F04B 39/0027 181/403
(Continued)

FOREIGN PATENT DOCUMENTS

EP 0 195 486 A2 9/1986
FR 2 713 702 6/1995

*Primary Examiner* — Edgardo San Martin
(74) *Attorney, Agent, or Firm* — Harrington & Smith

(57) ABSTRACT

The present invention relates to the technological field of acoustic filters applied to hermetic compressors. Problem to be solved: In hermetic compressors applied in cooling system, the work fluid sucked by the compression mechanism is hotter than the work fluid coming from the evaporator, and it is known that greater the temperature of this fluid, smaller is the efficiency of the compressor. Resolution of the problem: It is revealed a suction acoustic filter and a suction line including this acoustic filter capable of guarantee that the compression mechanism works mainly with the work fluid coming from the evaporator, which is colder than the work fluid accumulated inside the environment defined by the hermetic housing of compressor.

9 Claims, 6 Drawing Sheets

(51) Int. Cl.

| | |
|---|---|
| ***F04B 53/00*** | (2006.01) |
| ***F04B 39/12*** | (2006.01) |
| *F04C 29/00* | (2006.01) |
| *F04B 53/14* | (2006.01) |
| *F04B 53/16* | (2006.01) |

(58) Field of Classification Search
CPC ..... F04B 53/00; F04B 53/001; F04B 53/14; F04C 29/06; F04C 29/065; F04C 29/068
See application file for complete search history.

(56) References Cited

U.S. PATENT DOCUMENTS 4,793,775 A * 12/1988 Peruzzi ..... F04B 39/0055 417/312
5,451,727 A * 9/1995 Park ..... F04B 39/0044 181/229
5,888,055 A * 3/1999 Lee ..... F04B 39/0055 184/6.24
7,311,501 B2 * 12/2007 Wehrenberg ..... F04C 23/008 417/371
7,758,318 B2 * 7/2010 Yokota ..... F04B 39/0061 417/312
7,780,421 B2 * 8/2010 Freiberger ..... F04B 39/0061 181/247
7,866,955 B2 * 1/2011 Lilie ..... F04B 39/0061 181/403
8,230,968 B2 * 7/2012 Jung ..... F04B 39/123 181/212
8,235,683 B2 * 8/2012 Kinjo ..... F04B 39/0055 181/403
8,585,373 B2 * 11/2013 Park ..... F04B 39/0061 417/312
9,335,084 B2 * 5/2016 Lilie ..... F04B 39/06
10,119,530 B2 * 11/2018 Kim ..... F04B 39/0061
2005/0135955 A1 * 6/2005 Iversen ..... F04B 39/121 417/572
2008/0008603 A1 * 1/2008 Schoegler ..... F04B 39/0061 417/312
2008/0219863 A1 * 9/2008 Jung ..... F04B 39/0061 417/312
2009/0229303 A1 * 9/2009 Iversen ..... F04B 39/123 62/500

* cited by examiner

SUCTION ACOUSTIC FILTER AND SUCTION LINE INCLUDING SUCTION ACOUSTIC FILTER

FIELD OF THE INVENTION

The present invention refers to an acoustic filter for hermetic compressor and, more particularly, a suction acoustic filter including a nozzle specially for minimizing work fluid suction at high temperature. The present invention further relates to a suction line of hermetic compressor, which includes such suction acoustic filter including a nozzle specially for minimizing work fluid suction at high temperature.

Generally, the main purpose of the invention in question is related to functional optimization of the hermetic compressor minimizing the quantity of work fluid at high temperature sucked to the inside of the compression mechanism (piston-cylinder set).

BACKGROUND OF THE INVENTION

As it is known by technicians on the art, hermetic compressor comprises electromechanical devices capable of compress a work fluid by successive alteration of the internal volume of a compression chamber. Hermetic compressors are mainly applied in cooling systems.

This successive alteration of volume is carried out, in reciprocating hermetic compressors, by means of a compression mechanism fundamentally integrated by a piston-cylinder set, in which said piston is capable of be reciprocating displaced, on axial direction, inside the cylinder, altering the volume of it. It should be noted that said compression mechanism is enclosed inside the hermetic housing of the compressor.

Due to piston reciprocating movement, it can be stated that a reciprocating hermetic compressor operates in suction and exhaust reciprocating cycles of the work fluid.

Among the multiple functional variables existing in hermetic compressors, and in view of the scope of the present application, there are discussed two of these functional variables.

The first functional variable discussed refers to the temperature of the work fluid sucked by the compression mechanism, in which as higher the temperature of this fluid, lower will be the yield of the compressor. This functional variable is also broadly known by technicians on the art, besides being broadly described by technical specialized literature.

The current state of the art comprises multiple solutions especially for optimizing the first functional variable, this is, especially for cooling the work fluid temperature sucked by the compression mechanism. Document BRPI1100416, for example, describes the application of a pre evaporator inside the hermetic house of the compressor whose main objective is reducing the compression mechanism temperature, or still, the work fluid temperature sucked by the compression mechanism.

The second functional variable now approached refers to the noise level generated during hermetic compressor operation, noise that can come from different sources. The reciprocating between suction and exhaust cycles itself, during the compressor operation, is characterized by generating vibrations and pulsing noises extremely undesired.

The current state of the art comprises multiple solutions especially for optimizing the second functional variable, this is, especially for attenuation of the pulsing noise generated by the suction and exhaust cycles, and smog the solutions already known, it is highlighted the one known with suction acoustic filter. Suction acoustic filters are broadly known by technicians on the art, beyond being broadly described in specific technical literature. Generally, a suction acoustic filter comprises a chamber that, disposed in some part of the suction line, defines a broad volume (related to the volume of the suction line part) capable of minimizing the pulsing effects referred to the reciprocating between the suction cycles. Such functional principle is broadly known and applied in reciprocating hermetic compressors. Although the functional principle of a suction acoustic filter is invariable, the constructive possibilities and the assembling possibilities are wide. Embodiments are known of sealed suction acoustic filters (applied on hermetic or direct suction lines), and non-sealed suction acoustic filters (applied in equalized or indirect suction lines, and also applied on semi direct suction lines).

Different models of suction acoustic filters, with different purposes, are illustrated on FIGS. 1, 2 and 3.

The suction acoustic filter schematically illustrated on FIG. 1 is about a usual embodiment pertaining to the current state of the art. Such acoustic filter is totally integrated by a pre chamber A and a main chamber B. Said pre chamber A comprises a fluid inlet area A1 and a fluid outlet area A2, while main chamber B comprises a fluid inlet tubing B1 and a fluid outlet tubing B2. As illustrated, the fluid outlet area A2 of pre chamber A and the beginning of the fluid inlet tubing B1 of main chamber B confuses between them, this is because both are fluidly connected. Generally, said pre chamber A has just the function of fluid confinement, while main chamber B has the function of pulsing attenuation. Thus, is possible to say that suction acoustic filter schematically illustrated on FIG. 1 do not comprises any feature, characteristic or implement for optimizing the functional variable related to the work fluid temperature sucked by the compression mechanism.

The suction acoustic filter illustrated on FIG. 2 is about the suction acoustic filter described on document JP2001055976, where it is described a suction acoustic filter defined by an inlet C1, an internal volume C2 and an outlet C3, being such acoustic filter specially cooperating with an extensor D coming from the suction passer. One of the main ideas foreseen on document JP2001055976 is that the suction acoustic filter gets (be fed) work fluid free from eventual turbulences existing on the environment defined inside the hermetic housing of the compressor. It is also not said any feature, aspect or implement to optimizing the functional variable related to the work fluid temperature sucked by the compression mechanism.

The suction acoustic filter illustrated on FIG. 3 is about the suction acoustic filter described on document KR20020027794, where it is described a suction acoustic filter defined by a nozzle F1, an inlet pipe F4, an internal volume F2 and an outlet F3, being the nozzle F1 convergent, this is, with the inlet area greater than the outlet area.

Beyond the examples listed above, and having in mind the current understandings, it is known that the current state of the art lacks of a unified solution that, implemented in suction acoustic filters, be the optimization of the two functional variables before explained. It is based on this scenario that arises the invention in question.

Objectives of the Invention

Therefore, it is one of the objectives of the invention in question reveal a suction acoustic filter that, including a different nozzle, makes possible the suction and trapping of the work fluid on a temperature lower than the temperature of the work fluid existing on the internal environment of the hermetic housing, reaching the main majority of the observed benefits in systems capable of cooling the temperature of the work fluid sucked by compression mechanism. It is also one of the objectives of the invention in question that the suction acoustic filter including a nozzle reaches maximum optimization when related to pulsing noise attenuation generated by suction and exhaust cycles.

Additionally, it is one of the objectives of the invention in question reveal a suction line including a suction acoustic filter (including a nozzle) capable of optimizing the functioning of the hermetic compressor and, specially, capable of optimizing the efficiency of the hermetic compressor from the temperature reduction of the work fluid sucked by the compression mechanism and the reduction of the noise generated by the reciprocation between suction and exhaust cycles.

In this context, it is one of the main objectives of the invention in question that these optimizations are reached simply and non-costly, without the need to include further devices and/or systems.

SUMMARY OF THE INVENTION

All the objectives of the invention in question are reached by means of a suction acoustic filter, which comprises at least one inlet path, at least one acoustic chamber, at least one outlet path and at least one nozzle fluidly connected to at least one inlet path and having at least one fluid inlet and at least one fluid directing area for the inlet path of the suction acoustic filter.

According to the invention in question, said nozzle comprises at least one part of divergent section related to the main flow of outflow, being this part situated between at least one fluid inlet area and at least one fluid directing area.

Also according to the invention in question, it is revealed a suction line including a suction acoustic filter integrated by at least one suction passer and at least one suction acoustic filter comprised by at least one inlet path, at least one acoustic chamber, at least one outlet path and at least a nozzle fluidly connected to at least one inlet path and having at least one fluid inlet area and at least one fluid directing area for the inlet path of the suction acoustic filter. Said nozzle of the suction acoustic filter comprises at least one part of divergent section related to the main flow of outflow, being this part situated between at least one fluid inlet area and at least one fluid directing area.

According to the invention in question, the suction passer outlet is adjacent disposed to the fluid inlet area of the suction acoustic filter nozzle.

BRIEF DESCRIPTION OF THE DRAWINGS

The invention in question will be detailed based on the following listed figures, in which.

DETAILED DESCRIPTION OF THE INVENTION

Figure 1:
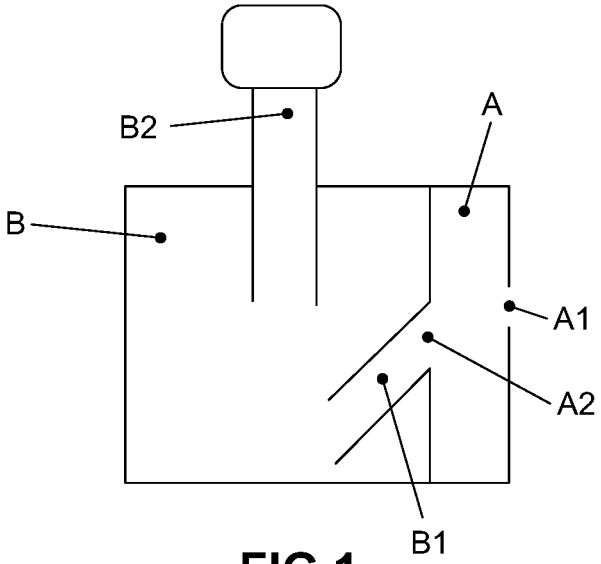
FIG.1 (PRIOR ART)
FIG. 1 illustrates, schematically, a suction acoustic filter pertaining to the current state of the art.
Figure 2:
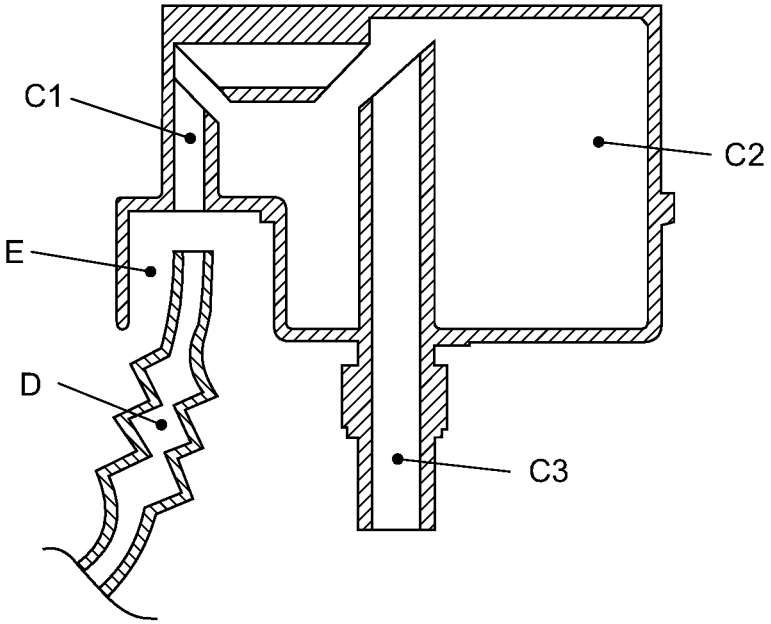
FIG.2 (PRIOR ART)
FIG. 2 illustrates the suction acoustic filter detailed on document JP2001055976 (state of the art)
Figure 3:
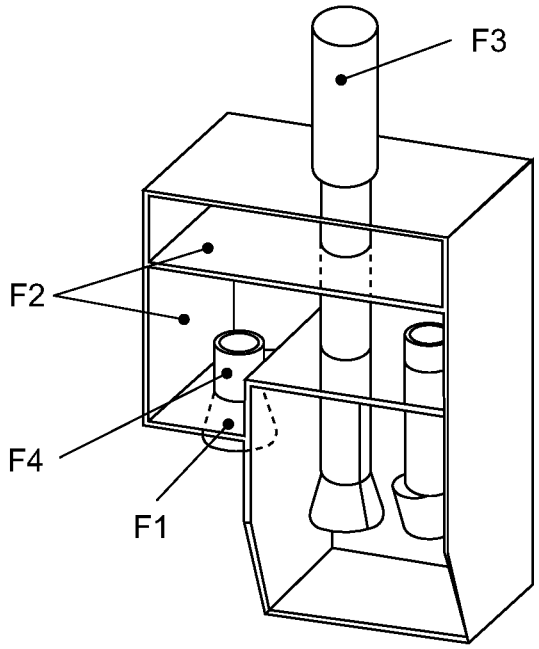
FIG.3 (PRIOR ART)
FIG. 3 illustrates the suction acoustic filter detailed on document KR20020027794 (state of the art)

As already mentioned, the current state of the art comprises some solutions dedicated to the cooling of the compression mechanism, or still, cooling means of the work fluid sucked by the compression mechanism. Such solutions of cooling, so ever are capable of maintaining said compression mechanism on a lower temperature, involve energetic costs, costs which can also damage the compressor efficiency.

Before the detailing of the embodiment of the inventions in question, it is important to define, punctually, the meaning of the expressions "main flow of outflow" and "pulsing reflux", following used as descriptive referential.

Main flow of outflow (FPE): Gas flow going from suction passer until the compression chamber.

Pulsing reflux (RP): Gas flow that return from the compression chamber to the internal of the suction acoustic filter and, eventually, outside the same due to the valves dynamic.

Thus, it is great the merit of the invention in question to keep the compression mechanism of the hermetic compressor to a lower temperature without being necessary to use the cooling means.

So, it is highlighted the invention in question because it reveals a mean capable of guarantee that just (or at least mainly) the work fluid directly coming from the suction passer of the compressor, whose fluid comes from the evaporation line (which presents lower temperature that the work fluid enclosed on the internal environment defined by the hermetic housing of compressor) be sucked by the compression mechanism.

Generally, such means are fundamentally composed by a nozzle that, preferentially (but not limitative) disposed on the external portion of the suction acoustic filter and fluidly connected to the inlet path of said suction acoustic filter, is capable of act as a kind of work fluid concentrator directly coming from the suction passer of compressor and, simultaneously, with a kind of barrier to suction of the work fluid enclosed on the internal environment defined by the compressor hermetic housing. In other words, said nozzle ends acting as a "cold fluid trap", blocking (or making difficult) that said cold fluid (coming directly from the suction passer of the compressor) to be homogeneous, thermally, with the work fluid enclose on the internal environment defined by the hermetic housing of the compressor.

The objectives of the invention in question are more explored based on the illustrative FIGS. 4, 5, 6, 7, 8, 9 and 10.

In this sense, the preferred embodiment of the invention in question (FIG. 4) has a suction acoustic filter 1 fundamentally formed by an inlet path 11, a main chamber 12 with functions of attenuating fluid flow pulsing (and, consequently, noise attenuation), and an outlet path 13, which is functionally liked with the compression mechanism head (not illustrated).

It worth to say that said suction acoustic filter 1 comprises, roughly, a suction acoustic filter conventional and also the generic. This means that the core of the invention in question (detailed as follows) can be applied in several models and constructions of suction acoustic filters, since such filter comprises at least one inlet path 11, at least one main chamber 12 and at least one outlet path 13. Preferably, and as illustrated on FIG. 4, the inlet path 11 and the outlet 13 are spaced apart, being said inlet path 11 disposed laterally on the suction acoustic filter 1. Said suction acoustic filter 1 comprises a nozzle 2 fluidly connected to at least one inlet path 11 and having a fluid inlet area 21 and a fluid directing area 22 for the inlet path 11 of the suction acoustic filter 1.

Moreover, and according to the invention in question, the nozzle 2 of said suction acoustic filter 1 comprises a part of divergent section 23 related to the main flow of outflow (FPE).

Figure 4:
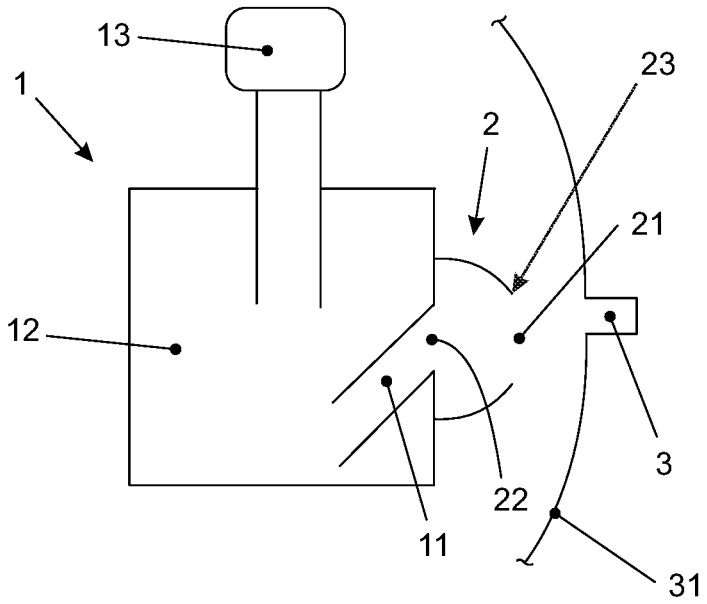
FIG. 4 illustrates the suction acoustic filter including a nozzle, according to the preferred embodiment of the invention in question.
Figure 5:
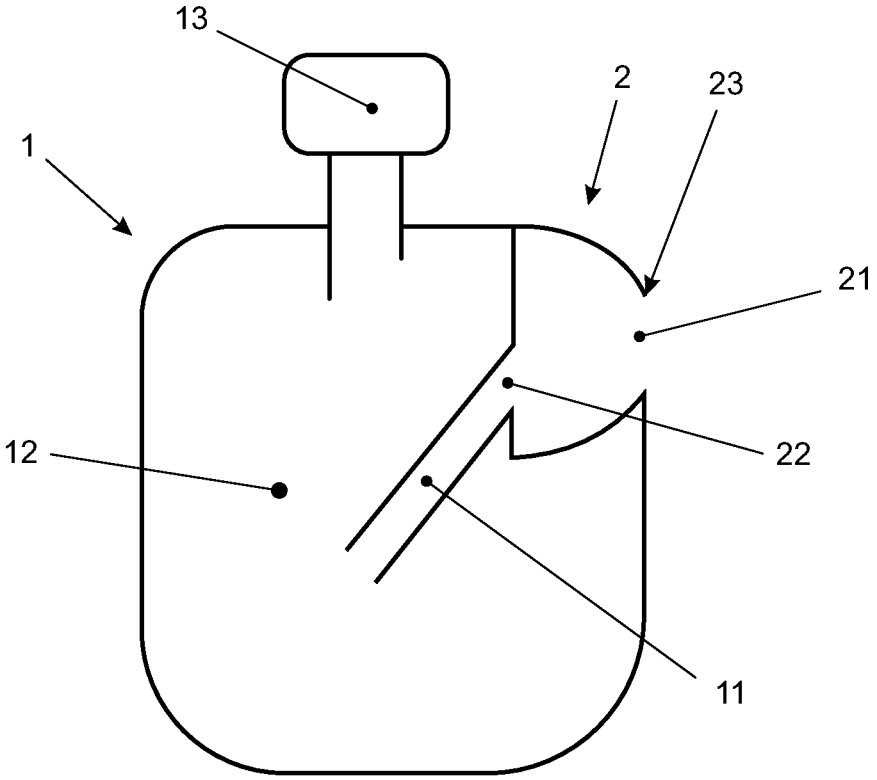
FIG. 5 illustrates the suction acoustic filter including a nozzle, according to one alternate embodiment of the invention in question.
Figure 6:
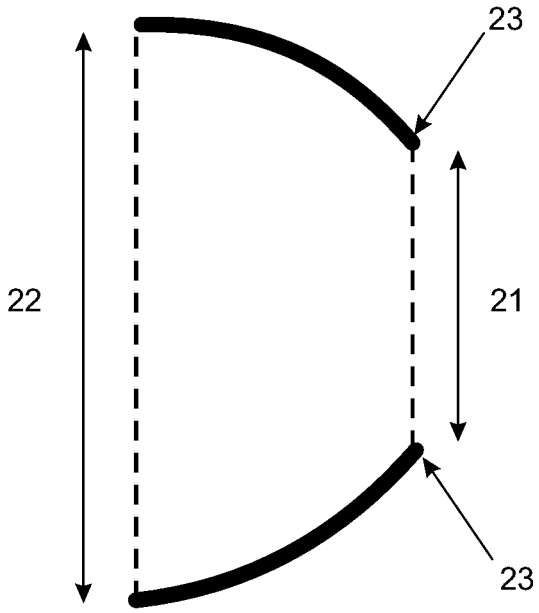
FIG. 6 illustrates, in enlarged detail, the nozzle, according to the invention in question.

As illustrated on FIGS. 4, 5 and 6, the part of divergent section 23—related to the main flow of outflow (FPE)—comprises the own fluid inlet 21, which have a smaller area than the fluid directing area 22. Particularly according to the preferential embodiment of the invention, the inlet area of the nozzle 21 is, at maximum, 50% lower than the fluid directing area 22.

Figure 7:
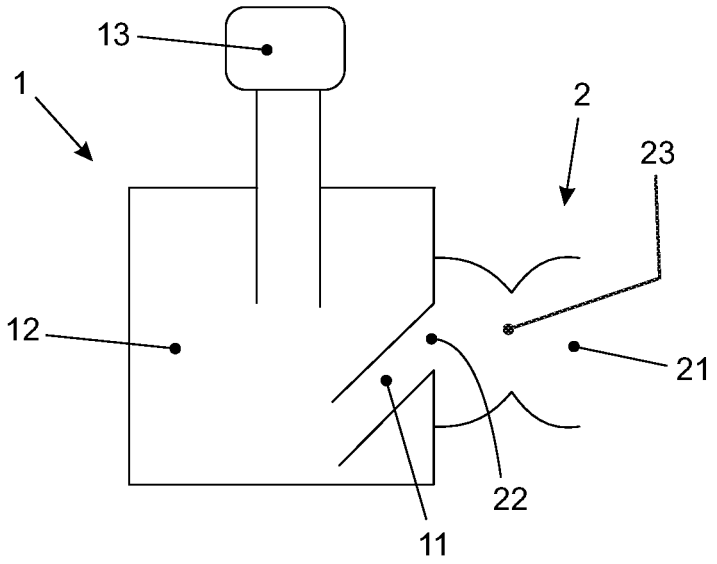
FIGS. 7 and 8 illustrates other alternatives for the suction acoustic filter including a nozzle, according to the invention in question.
Figure 8:
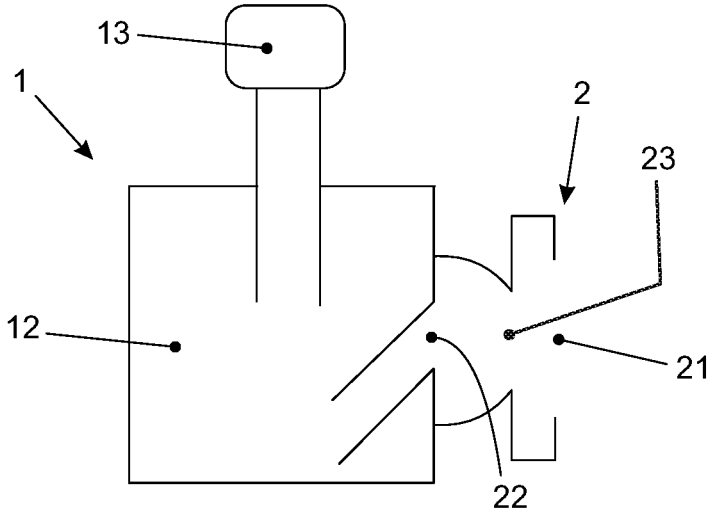

In FIGS. 7 and 8—that illustrates possible alternate embodiments—the part of divergent section 23—related to the main flow of outflow (FPE)—comprises kind of a narrow or choke related to the pulsing reflux direction (RP), where the fluid inlet area 21 is larger than the fluid directing area 22.

The existence of the divergent section part 23—related to the main flow of the outflow (FPE)—is on the own fluid inlet area 21 of nozzle 2 or between the fluid inlet area 21 and the fluid directing area 22—it is about one of the most preponderant features of the invention in question, after all, this is the part where the area suffers a reduction—related to the pulsing reflux (RP)—that is responsible by the work fluid trapping directly coming from the compressor suction passer and that defines the barrier to the suction of the work fluid enclosed on the internal environment defined by the hermetic housing of the compressor.

Figure 9:
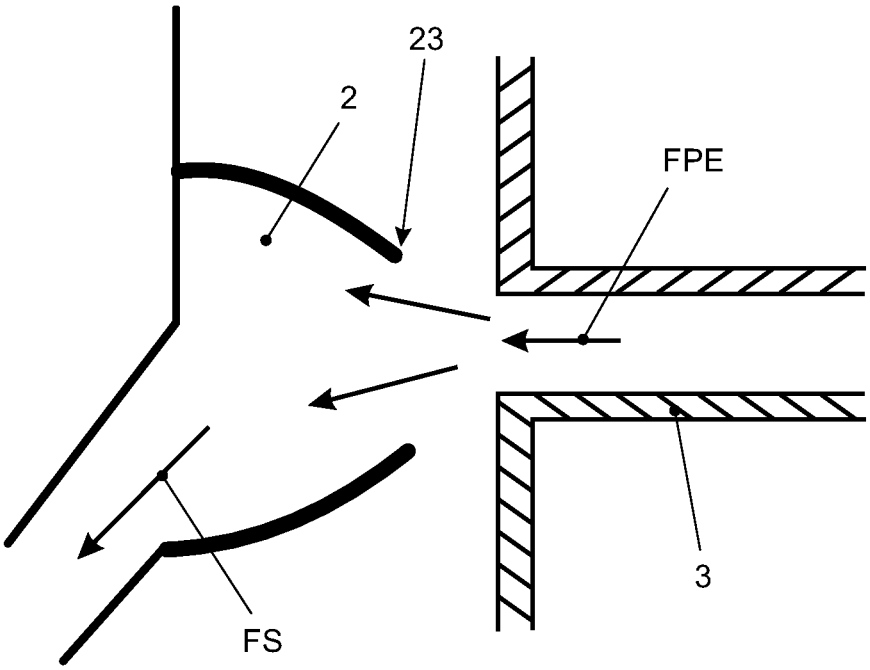
FIGS. 9 and 10 illustrates, schematically, work "situations" in which the suction acoustic filter including a nozzle is exposed.

As illustrated on FIG. 9, it can be stated that nozzle 2 defines a volume with at least one divergent part considering the direction of the main flow outflow (FPE). This way, the fluid coming from the suction passer is directed and stored inside the nozzle 2, for, then, be converted in "suction fluid" FS, which enters on the suction acoustic filter 1 by the inlet path 11 whose fluid directing area 22 of the nozzle 2 communicates. At the most, it is further verified that the "housing fluid" FC is mainly blocked from entering on the nozzle 2.

Figure 10:
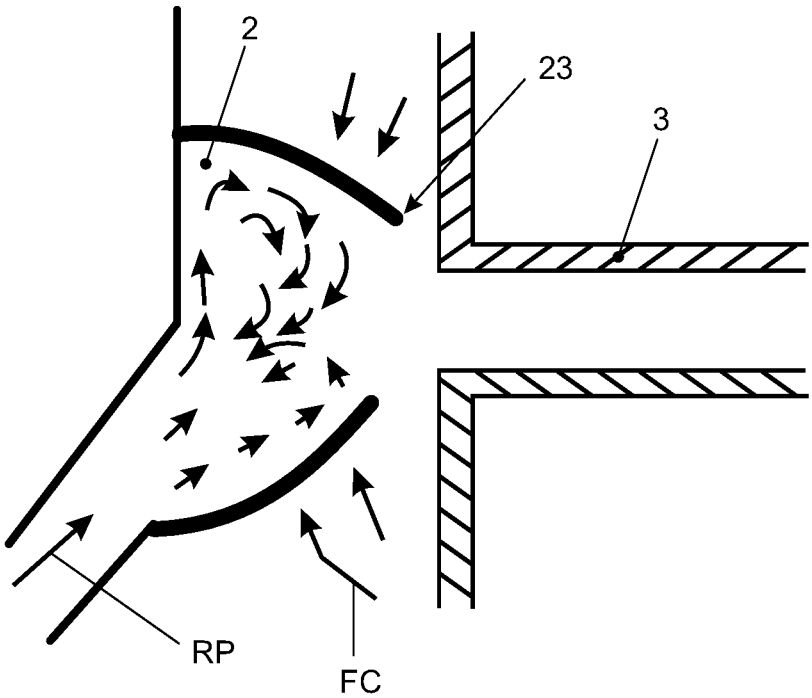

As illustrated on FIG. 10, it can be said that the nozzle 2 defines a volume with at least one convergent part, now considering the direction of the pulsing reflux (RP). This ends blocking or making difficult fluid outlet at low temperature of said pulsing reflux (RP) for the environment out of the nozzle 2.

As the suction dynamic of reciprocating hermetic compressors is fundamentally constant (pulsed in high frequency), there is no sufficient time so the temperature of the "suction fluid" FS increase related to the temperature of the main flow fluid of outflow (FPE). This way, said volume of nozzle 2 ends acting as work fluid accumulator at "low" temperature.

The potentiation of this thermal dynamic, by the suction line including a suction acoustic filter here revealed, is other great merit of the invention in question.

According to the suction line including suction acoustic filter here revealed, the suction passer 3 of the hermetic compressor 31, shown on FIG. 4, have its adjacent outlet to the fluid inlet area 21 of nozzle 2 of the suction acoustic filter 1. Evidently, when closer and aligned the suction passer 3 of the hermetic compressor and the fluid inlet area 21 of the nozzle of the suction acoustic filter 1, greater will be the work fluid concentration effects directly coming from the evaporation line, and better will be the barrier to the work fluid suction enclosed on the internal environment defined by the hermetic housing of the compressor.

Related to the constructive features more predominant of the preferred embodiment of the suction acoustic filter 1, it remains to emphasizes that—preferentially, but not limitative—said nozzle 2 comprises a modular body to the suction acoustic filter 1, this is, comprises an independent body related to the suction acoustic filter 1. On this embodiment, the nozzle 2 is fixed to the suction acoustic filter 1 by a hermetic fixing means, as for example, a sealing and glutinous resin.

Alternatively, it is observed that the nozzle 2 could comprise also a body integrated with the suction acoustic filter 1, this is, both bodies are part of the same monoblock. In this alternative embodiment, such monoblock could be made by thermoforming processes, for example.

Additionally, and considering that the preferred embodiment of the suction acoustic filter 1 foresee inlet paths 11 and outlet 13, where the inlet path 11 is disposed laterally on the suction acoustic filter 1, it is worth to say that—preferably, but not limitative—the fluid inlet 21 of the nozzle 2 is laterally disposed related to said suction acoustic filter 1.

Now related to the suction line itself, it remains to emphasize that the suction passer outlet 3 can be directly or indirectly aligned to the fluid inlet area 21 of the nozzle 2 of the suction acoustic filter 1, in a way that on the indirect option, it is foreseen the use of an extensor pipe (not illustrated).

Preferentially, said nozzle 2 should have a maximum volume approximate the same as half the volume displaced from the compressor, because this would be the maximum fluid volume accumulated during a cycle.

Figure 11A:
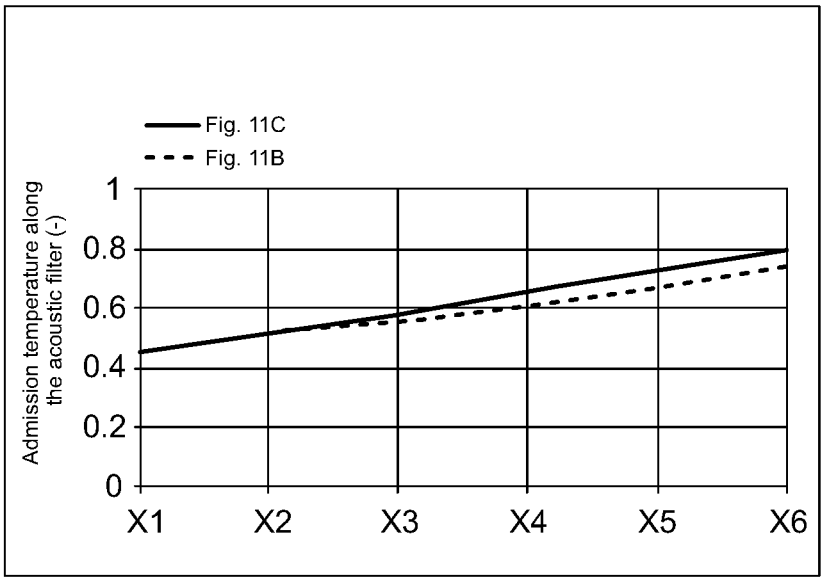
FIG. 11A illustrates a comparative graphic of temperature between the suction acoustic filter including the nozzle according to the preferred embodiment of the invention in question (see references on FIG. 11B) and a suction acoustic filter already established on the literature (see references on FIG. 11C).
Figure 11B:
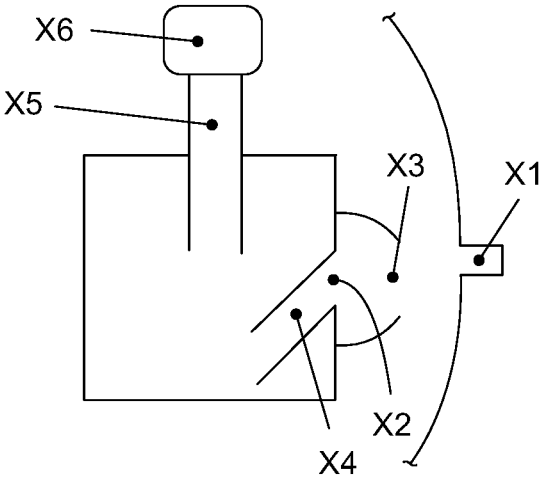
Figure 11C:
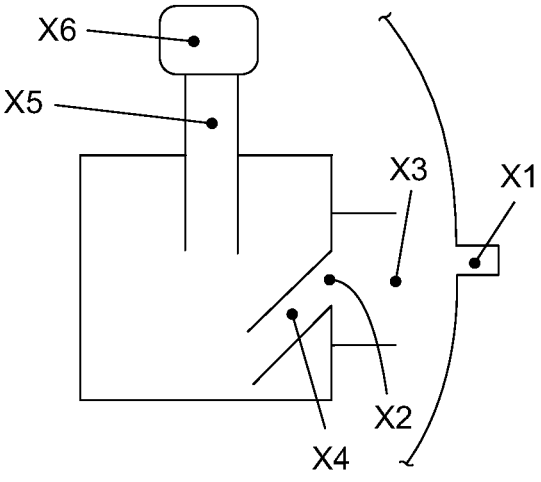

FIG. 11A, that refers to the specific areas illustrated on FIGS. 11B and 11C shows a graphic where is demonstrated that the suction acoustic filter 1 with nozzle 2 including a divergent section part 23 is more effective thermodynamically than the acoustic filter belonging to the current state of the art illustrated on FIG. 11C, because the temperature of the fluid on the outlet of the acoustic filter is lowered.

Having being described and illustrated several embodiments of the invention in question, it should be understood that the protection scope in question can englobe other possible variations, in which are limited just by the claims, here included the possible equivalent means.

The invention claimed is:

1. A suction line of a hermetic compressor, said suction line comprising a suction acoustic filter with:

at least one inlet path, at least one acoustic chamber, and at least one outlet path;

at least one nozzle fluidly connected to the at least one inlet path and having at least one fluid inlet area and at least one fluid directing area for the inlet path of the suction acoustic filter, said at least one fluid inlet area being in fluid communication with a housing of the hermetic compressor;

the suction line being characterized by:

said nozzle comprises at least one part of divergent section related to the main flow of the outflow (FPE); and said part of divergent section being situated between the at least one fluid inlet area and the at least one fluid directing area, whereby said part is adapted to block the fluid from the housing of the hermetic compressor from entering on the nozzle.

2. Suction line according to claim 1, characterized by the fact that the part of divergent section related to (FPE) comprises a cross-sectional area smaller than the fluid directing area.

3. Suction line according to claim 1, characterized by the fact that said nozzle comprises a modular body to suction acoustic filter.

4. Suction line according to claim 3, characterized by the fact that said nozzle is fixed to the suction acoustic filter by a hermetic fixing means.

5. Suction line according to claim 1, characterized by the fact that said nozzle comprises an integrated body to the suction acoustic filter.

6. Suction line according to claim 1, characterized by the fact that the fluid inlet of the nozzle is situated laterally disposed related to said suction acoustic filter.

7. Suction line according to claim 1, characterized by the fact that it comprises at least one suction passer with an outlet adjacently disposed on the fluid inlet area of the nozzle of the suction acoustic filter.

8. Suction line according to claim 7, characterized by the fact that the suction passer outlet is adjacently disposed, directly, to the fluid inlet area of the nozzle of the suction acoustic filter.

9. Suction line according to claim 7, characterized by the fact that the suction passer outlet is adjacently disposed, indirectly, to the fluid inlet area of the nozzle of the suction acoustic filter.

* * * * *